US008125108B2

(12) United States Patent
Yamagiwa

(10) Patent No.: US 8,125,108 B2
(45) Date of Patent: Feb. 28, 2012

(54) REMOTE CONTROL TRANSMITTER

(75) Inventor: Tsutomu Yamagiwa, Osaka (JP)

(73) Assignee: Panasonic Corporation, Osaka (JP)

( * ) Notice: Subject to any disclaimer, the term of this patent is extended or adjusted under 35 U.S.C. 154(b) by 868 days.

(21) Appl. No.: 12/190,879

(22) Filed: Aug. 13, 2008

(65) Prior Publication Data

US 2009/0051580 A1 Feb. 26, 2009

(30) Foreign Application Priority Data

Aug. 24, 2007 (JP) ..... 2007-217942
May 9, 2008 (JP) ..... 2008-123093

(51) Int. Cl.
*H01H 45/00* (2006.01)

(52) U.S. Cl. ..... 307/118; 307/27; 307/116

(58) Field of Classification Search ..... 340/12.27; 307/27, 116, 118
See application file for complete search history.

(56) References Cited

U.S. PATENT DOCUMENTS 5,684,471 A * 11/1997 Bernardi et al. ..... 340/12.27
2003/0227406 A1* 12/2003 Armstrong ..... 341/176

FOREIGN PATENT DOCUMENTS

JP 2006-033680 A 2/2006

* cited by examiner

*Primary Examiner* — Robert L. Deberadinis
(74) *Attorney, Agent, or Firm* — RatnerPrestia

(57) ABSTRACT

A control part for causing transmission of a remote control signal from a transmission part according to a resistance of a pressure-sensitive conductive contact part causes periodic transmission of a repetition signal, when the resistance of the pressure-sensitive conductive contact part is kept constant. Thus, when an operating body is continuously held down with a constant force and the resistance of the pressure-sensitive conductive contact part is kept constant, the control part causes periodic transmission of the repetition signal having a smaller number of pulses, at predetermined intervals. With such an operation, a remote control transmitter capable of reducing power consumption is provided.

6 Claims, 6 Drawing Sheets

REMOTE CONTROL TRANSMITTER

BACKGROUND OF THE INVENTION

1. Field of the Invention

The present invention relates to a remote control transmitter for use in remote control operation mainly on various types of electronic equipment.

2. Background Art

In the recent promotion of enhancing the functionality of various types of electronic equipment, such as a television, video player, and air conditioner, a remote control transmitter capable of ensuring various kinds of operations is also required for remote-controlling such equipment.

A description is provided of such a conventional remote control transmitter, with reference to FIG. 7 and FIG. 8. FIG. 7 is a sectional view of a conventional remote control transmitter. With reference to FIG. 7, a plurality of operating bodies made of an insulating resin are placed in a plurality of open holes provided through the top face of box-shaped case 1 made of an insulating resin so that the operating bodies are vertically movable.

Pressure-sensitive conductive sheet (hereinafter simply referred to as "conductive sheet") 3 includes conductive particles dispersed in a base material made of silicone rubber or the like. Wiring board 4 has wiring patterns (not shown) formed on the top and bottom faces thereof. Conductive sheet 3 is placed above the top face of wiring board 4. On the top face of wiring board 4, a pair of fixed contacts 5 made of copper, carbon, or the like are formed.

Spacer 6 made of an insulating resin is formed between conductive sheet 3 and wiring board 4 so as to surround a plurality of fixed contacts 5. The bottom face of conductive sheet 3 and fixed contacts 5 are opposed to each other so that a predetermined clearance is provided therebetween. Thus, a plurality of pressure-sensitive conductive contact parts (each hereinafter "contact part") 7 are formed. Further formed on the bottom face of wiring board 4 are transmission part 8 made of a light emitting diode or the like, and control part 9 made of a microcomputer or the like and causing transmission of a remote control signal from transmission part 8 according to electrical connection in contact part 7 or resistance thereof. Cover 10 made of an insulating resin covers the bottom face of case 1.

While a program list or the like is displayed on the display screen of a liquid crystal device or the like of electronic equipment to be remote-controlled, the conventional remote control transmitter structured as above is directed to the electronic equipment, and one of operating bodies 2 is pressed with a finger. With this operation, the bottom face of this operating body 2 presses conductive sheet 3. Conductive sheet 3 flexes downwardly and makes contact with a corresponding pair of fixed contacts 5. The pair of fix contacts 5 is electrically connected via conductive sheet 3.

FIG. 8 is a chart showing a signal waveform supplied from the conventional remote control transmitter. With reference to FIG. 8, when one of operating bodies 2 is continuously held down with a constant force, operation signal A1 is transmitted from transmission part 8 to the remote control receiver periodically and repeatedly at intervals of 20 to 50 msec. Further, when another one of operating bodies 2 is pressed, the electrical connection in corresponding contact part 7 and changes in the resistance between corresponding fixed contacts 5 are detected by control part 9. A remote control signal corresponding to the pressing operation is transmitted from transmission part 8. In response to the transmitted remote control signal, the cursor displayed on the display screen of the electronic equipment moves in the downward or horizontal direction, for example.

In this manner, the conventional remote control transmitter is structured so that pressing a plurality of operating bodies 2 allows remote control of the moving direction, speed, or the like of the cursor displayed on the display screen of the electronic equipment.

Japanese Patent Unexamined Publication No. 2006-33680 is an example of the known information on the conventional techniques related to this invention.

However, the conventional remote control transmitter has the following problem. When one of operating bodies 2 is continuously held down with a constant force, the same operation signal A1 is periodically and repeatedly transmitted from transmitter 8 at predetermined intervals as shown in FIG. 8, although the moving direction and speed of cursor 33 on display screen 31 are unchanged. This operation causes continuous power supply from the battery stored in the remote control transmitter to transmission part 8 and control part 9, thus consuming the battery.

SUMMARY OF THE INVENTION

The present invention provides a remote control transmitter capable of saving power and making various kinds of remote control operations on equipment.

In a remote control transmitter of the present invention, a control part for causing transmission of a remote control signal from a transmission part according to a resistance of a pressure-sensitive conductive contact part causes periodic transmission of a repetition signal, when the resistance of the pressure-sensitive conductive contact part is kept constant. In other words, when an operating body is continuously held down with a constant force and the resistance of the corresponding pressure-sensitive conductive contact part is kept constant, the control part causes periodic transmission of the repetition signal having a smaller number of pulses, at predetermined intervals.

In a remote control transmitter of the present invention, a control part for causing transmission of a remote control signal from a transmission part according to a resistance of a pressure-sensitive conductive contact part causes transmission of a continuation signal and thereafter stops transmission, when the resistance of the pressure-sensitive conductive contact part is kept constant. In other words, when an operating body is continuously held down with a constant force and the resistance of the corresponding pressure-sensitive conductive contact part is kept constant, the control part causes transmission of a continuation signal having a predetermined number of pulses and thereafter stops transmission.

Such a structure can reduce the consumption of the internal battery. Thus, a remote control transmitter capable of saving power and making various kinds of remote control operations on equipment can be provided.

DETAILED DESCRIPTION OF THE INVENTION

First Embodiment

Figure 1:
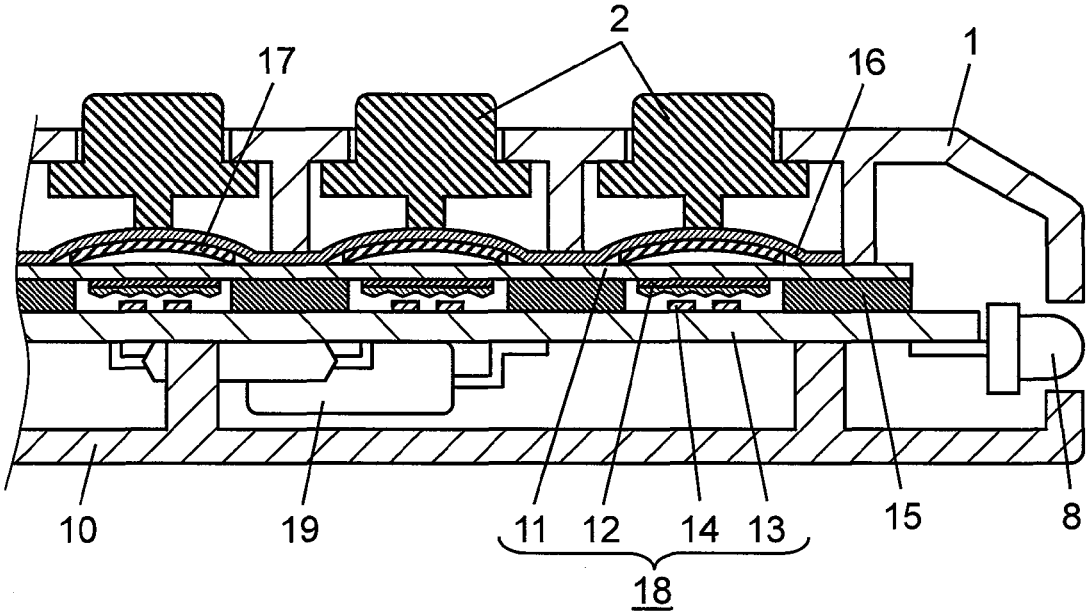
FIG. 1 is a sectional view of a remote control transmitter in accordance with a first exemplary embodiment of the present invention.
Figure 2:
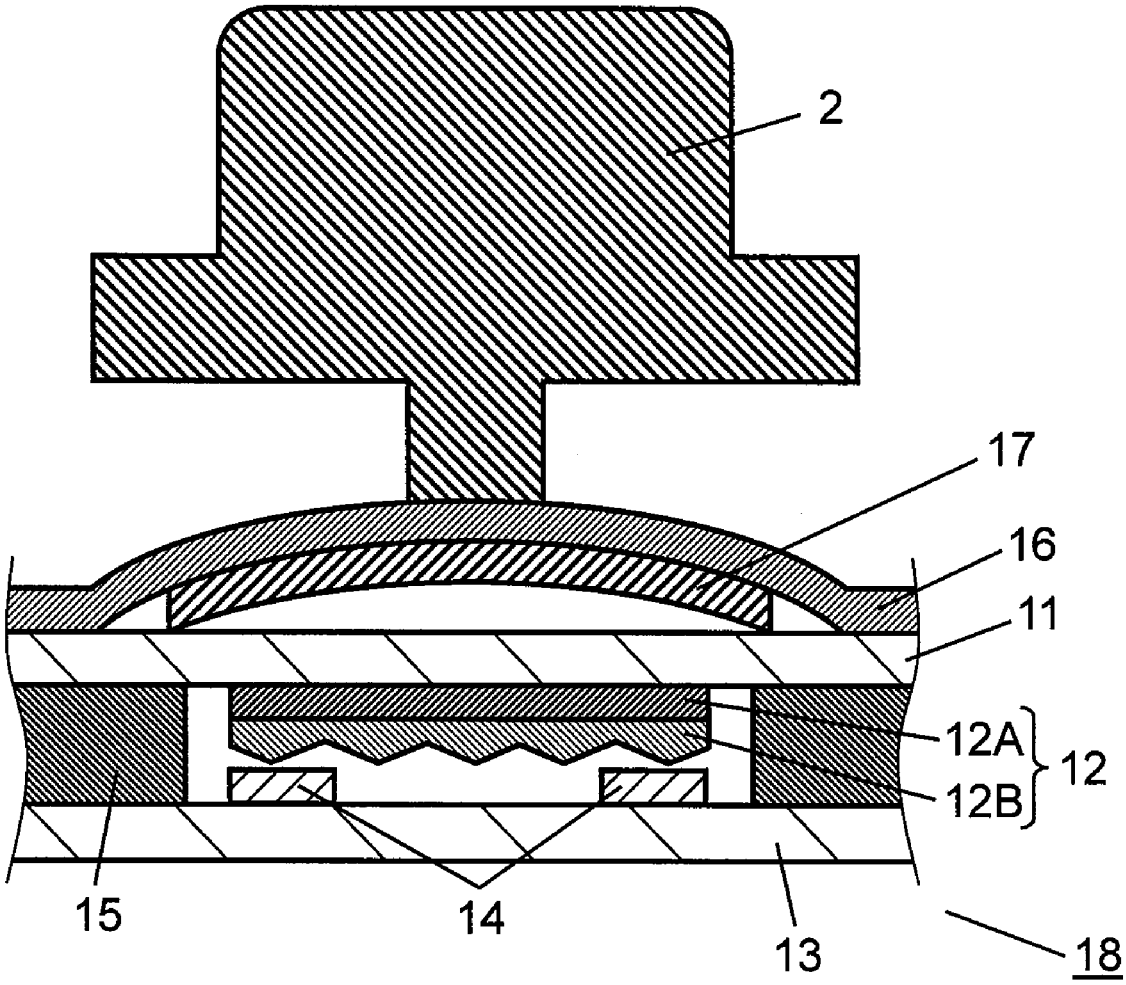
FIG. 2 is a sectional view of a pressure-sensitive conductive contact part in the remote control transmitter in accordance with the first exemplary embodiment of the present invention.

FIG. 1 is a sectional view of a remote control transmitter in accordance with the first exemplary embodiment of the present invention. FIG. 2 is a sectional view of a pressure-sensitive conductive contact part in the remote control transmitter in accordance with the first exemplary embodiment of the present invention. With reference to FIG. 1 and FIG. 2, box-shaped case 1 is made of an insulating resin, such as polystyrene and ABS. Operating bodies 2 made of an insulating resin are placed in corresponding open holes through the top face of case 1 so that the operating bodies are vertically movable.

Film-shaped base sheet 11 is made of a flexible material, such as polyethylene terephthalate, polycarbonate, and polyimide. A plurality of pressure-sensitive conductive layers (each hereinafter simply referred to as "conductive layer") 12 are formed on the bottom face of base sheet 11. Each of the conductive layers is formed by printing low-resistance layer 12A having carbon particles dispersed in a synthetic resin, and high-resistance layer 12B having fine asperities on the bottom face thereof so that both layers are laminated. The sheet resistance of low-resistance layer 12A is in the range of 0.5 to 30 kΩ/□. The sheet resistance of high-resistance layer 12B is in the range of 50 kΩ/□ to 5 MΩ/□.

Plate-shaped wiring board 13 is made of a paper phenol resin, glass epoxy resin, or the like. A plurality of wiring patterns (not shown) made of a copper foil or the like are formed on the top and bottom faces of wiring board 13. Base sheet 11 is placed on the top face of wiring board 13 via spacer 15. Further, on the top face of wiring board 13, a pair of fixed contacts 14 made of copper, carbon, gold plating, or the like is formed in a comb or semicircular shape.

Between base sheet 11 and wiring board 13, spacer 15 made of an insulating resin, such as epoxy and polyester, is formed so as to surround a plurality of fixed contacts 14. Spacer 15 allows conductive layers 12 on the bottom face of base sheet 11 to be opposed to corresponding fix contacts 14 with a clearance of 10 to 100 μm provided therebetween.

Film-shaped cover sheet 16 has flexibility similar to that of base sheet 11. Dome-shaped movable contact 17 is formed of a conductive thin metal plate made of a steel, copper alloy, or the like. A plurality of movable contacts 17 are bonded to the bottom face of cover sheet 16 with an adhesive (not shown) made of acrylic, silicone, or the like. The plurality of movable contacts 17 are placed on the top face of base sheet 11 provided on conductive layers 12. Thus, a plurality of pressure-sensitive conductive contact parts (each hereinafter "contact part") 18 are formed.

The bottom faces of the plurality of operating bodies 2 are in contact with the top faces of movable contacts 17 in the plurality of contact parts 18 via cover sheet 16. Formed on the bottom face of wiring board 13 are transmission part 8 for transmitting a remote control signal from an electronic component, such as a light emitting diode, and control part 19 for causing transmission of a remote control signal from transmission part 8 according to the electrical connection in contact part 18 and the resistance thereof. Further, the plurality of fixed contacts 14 and transmission part 8 are coupled to control part 19 and the battery power supply (not shown) via the wiring patterns. Cover 10 made of an insulating resin covers the bottom face of case 1. Thus, a remote control transmitter of the present invention is formed.

Figure 3A:
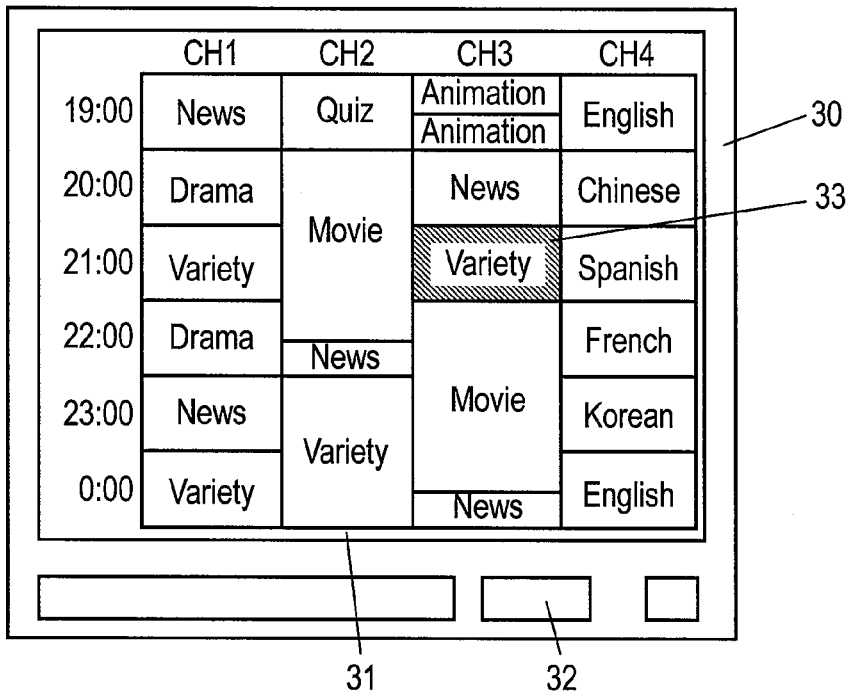
FIG. 3A shows a program list displayed on a display screen of electronic equipment.
Figure 3B:
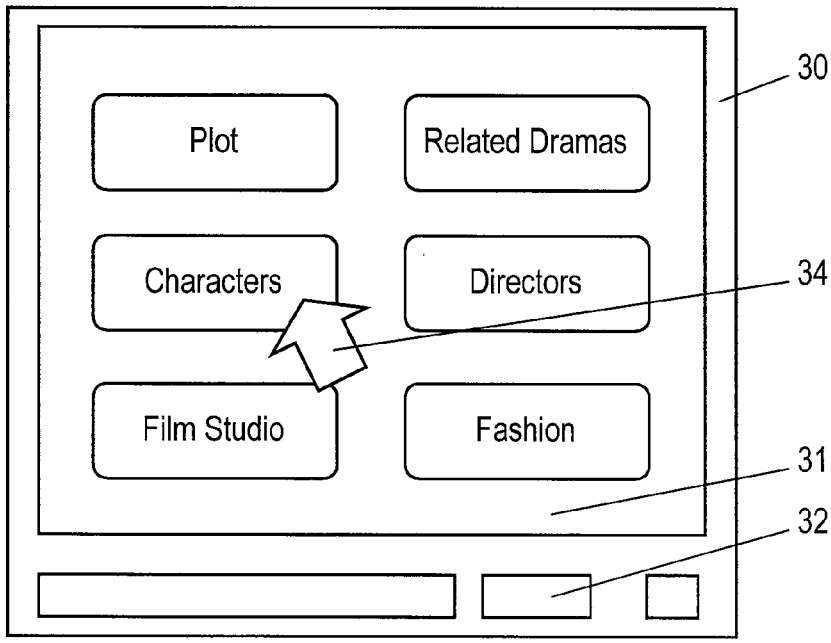
FIG. 3B shows a program introduction menu displayed on the display screen of the electronic equipment.

FIG. 3A shows a program list displayed on a display screen of electronic equipment. FIG. 3B shows a program introduction menu displayed on the display screen of the electronic equipment. With reference to FIG. 3A and FIG. 3B, remote control receiver 32 built in electronic equipment 30, such as a television, causes various kinds of operations on the equipment, upon receipt of a remote control signal from the remote control transmitter.

While a program list, a program introduction menu, or the like is displayed on display screen 31 of the liquid crystal display device or the like of electronic equipment 30 to be remote-controlled, the remote control transmitter is directed to the equipment and one of operating bodies 2 is pressed with a finger. With this operation, the bottom face of this operating body 2 presses the central portion of the top face of corresponding movable contact 17 via cover sheet 16. Application of a predetermined pressing force resiliently inverts movable contact 17 downward with tactile feedback, thereby flexing base sheet 11 downward. Conductive layer 12 on the bottom face of base sheet 11 is brought into contact with the corresponding pair of fixed contacts 14, and the pair of fixed contacts 14 is electrically connected via conductive layer 12.

Figure 4A:
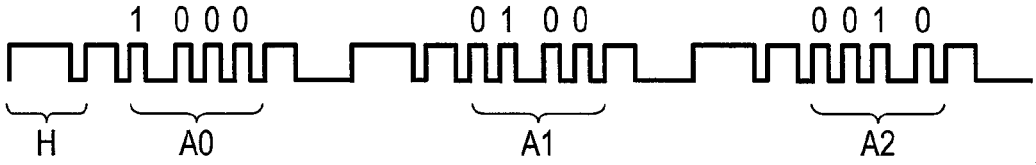
FIG. 4A is a chart showing a signal waveform transmitted from the remote control transmitter in accordance with the first exemplary embodiment of the present invention.

FIG. 4A is a chart showing a signal waveform transmitted from the remote control transmitter in accordance with the first exemplary embodiment of the present invention. With reference to FIG. 4A, control part 19 detects electrical connection in contact part 18, and causes transmission of operation signal A0 made of pulses combining a plurality of 0s and 1 together with header signal H or the like, from transmission part 8 to electronic equipment 30, as an infrared remote control signal. The transmitted signal is received by remote control receiver 32 built in electronic equipment 30. Then, for example, cursor 33 or pointer 34 displayed on display screen 31 is moved upward (see FIGS. 3A and 3B).

Figure 5:
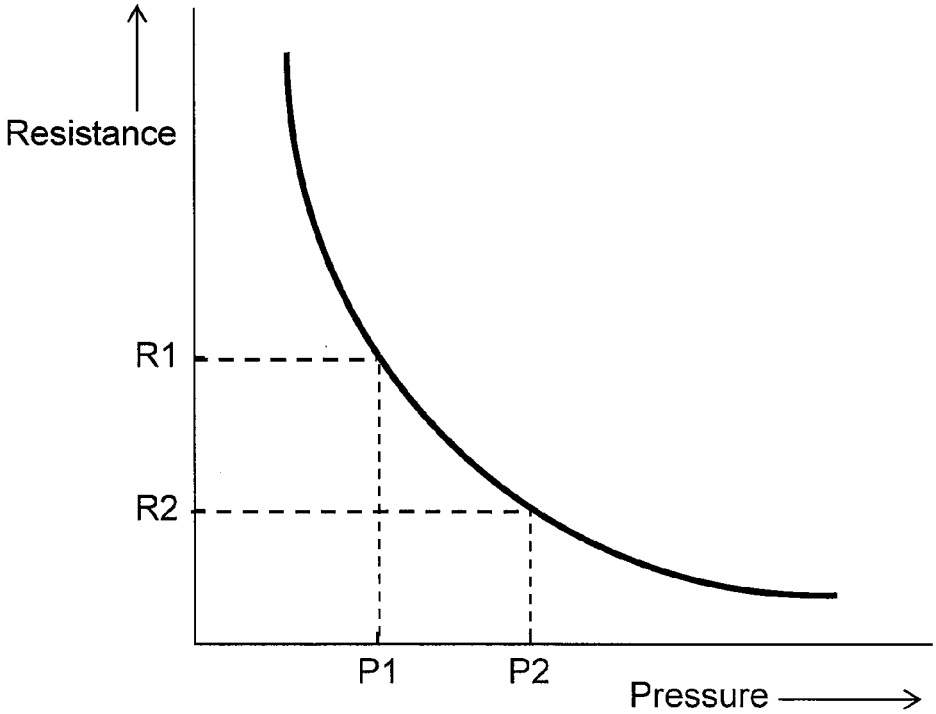
FIG. 5 is a graph showing the relation between a pressing force applied to an operating body of the remote control transmitter and a resistance between the contacts in accordance with the first exemplary embodiment of the present invention.

FIG. 5 is a graph showing the relation between a pressing force applied to an operating body of the remote control transmitter and a resistance between the corresponding fixed contacts in accordance with the first exemplary embodiment of the present invention. With reference to FIG. 5, as operating body 2 is pressed, the pressing force applied via movable contact 17 increases the area in which high-resistance layer 12B having fine asperities on the bottom face of conductive layer 12 is in contact with fixed contacts 14 under conductive layer 12. Therefore, according to pressing forces P1 and P2, the resistance between the pair of fixed contacts 14 is decreased.

The changes in the resistance of contact part 18 are detected by control part 19. Then, as shown in FIG. 4A, subsequent to operation signal A0, operation signal A1 corresponding to resistance R1 and operation signal A2 corresponding to resistance R2 of FIG. 5, for example, are transmitted from transmission part 8 to electronic equipment 30, as a remote control signal. This signal is received by remote control receiver 32 built in electronic equipment 30. Then, for example, the moving speed of cursor 33 and pointer 34 is increased. Thus, cursor 33 or pointer 34 displayed on display screen 31 moves upward at a higher speed.

Figure 4B:
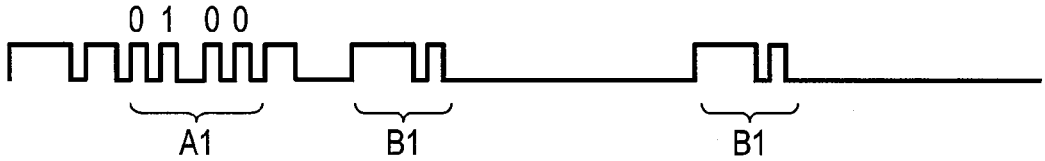
FIG. 4B is a chart showing another signal waveform transmitted from the remote control transmitter in accordance with the first exemplary embodiment of the present invention.

FIG. 4B is a chart showing another signal waveform transmitted from the remote control transmitter in accordance with the first exemplary embodiment of the present invention. With reference to FIG. 4B, when operating body 2 is continuously held down with a constant force, control part 19 detects that the resistance of corresponding contact part 18 is kept constant without any change. For example, when the operating body is pressed with pressing force P1 that sets the resistance of contact part 18 at R1, subsequent to operation signal A1 corresponding to resistance R1, repetition signal B1 having a smaller number of pulses than operation signal A1 is periodically and repeatedly transmitted from transmission part 8 to remote control receiver 32 at intervals of 20 to 50 msec. When remote control receiver 32 receives the remote control signal in which repetition signal B1 is repeated after operation signal A1, cursor 33 or pointer 34 displayed on display screen 31 is moved upward at a constant moving speed corresponding to resistance R1.

In this manner, pressing operating body 2 causes electrical connection in contact part 18 and changes the resistance thereof. Control part 19 detects such connection and changes, and causes transmission of a remote control signal corresponding to the operation from transmission part 8. Then, cursor 33 or pointer 34 displayed on display screen 31 is moved downwardly or horizontally, for example. Continuously holding down operating body 2 with a constant force causes cursor 33 or pointer 34 to move at a constant speed.

When operating body 2 is continuously held down with a constant force (e.g. pressing force P1), and the resistance of contact part 18 is kept constant at R1, control part 19 detects this constant state and causes transmission of a remote control signal in which repetition signal B1 having a smaller number of pulses is periodically repeated, instead of a remote control signal in which operation signals A1 and A2 having a larger number of pulses are repeated. In other words, while operating body 2 is continuously held down with a constant force and the moving direction and speed of cursor 33 or pointer 34 displayed on display screen 31 are kept constant, a remote control signal made of repetition signal B1 having a smaller number of pulses is transmitted. Such an operation reduces the current consumed by signal transmission and battery consumption in comparison with the case where operation signal A1 having a larger number of pulses is repeated.

In the remote control transmitter of the first exemplary embodiment of the present invention, contact part 18 is formed by opposing conductive layer 12 on the bottom face of base sheet 11 to a pair of fixed contacts 14 with a predetermined clearance provided therebetween, and placing movable contact 17 on the top face of base sheet 11. With this structure, pressing operating body 2 can provide an excellent operation feel with tactile feedback, and securely brings conductive layer 12 into electrical contact with fixed contacts 14. Further, low-resistance layer 12A and high-resistance layer 12B having fine asperities on the bottom face thereof are laminated to form conductive layer 12. This structure can provide stable changes in resistance corresponding to changes in pressing force, with few variations.

As described above, in the first exemplary embodiment, control part 19 for causing transmission of a remote control signal from transmission part 8 according to the resistance of contact part 18 causes periodic transmission of repetition signal B1 when the resistance of contact part 18 is kept constant. In other words, when operating body 2 is continuously held down with a constant force and the resistance of contact part 18 is kept constant, control part 19 causes periodic transmission of repetition signal B1 having a smaller number of pulses at predetermined intervals. This operation can reduce the consumption of the internal battery. Thus, a remote control transmitter capable of saving power and making various kinds of remote control operations on equipment can be provided.

Second Embodiment

Figure 6A:
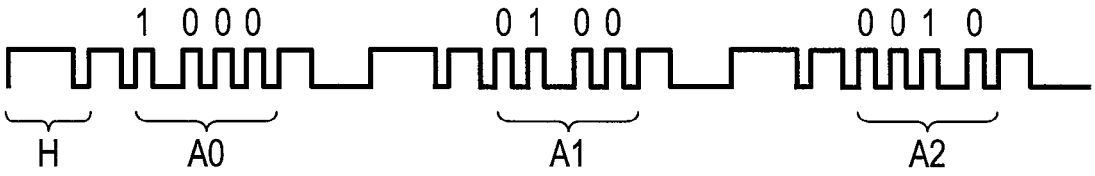
FIG. 6A is a chart showing a signal waveform transmitted from a remote control transmitter in accordance with a second exemplary embodiment of the present invention.
Figure 6B:
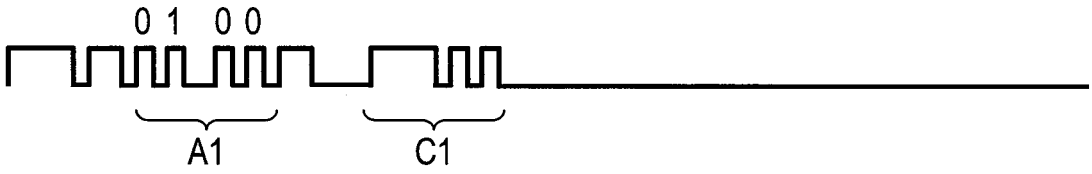
FIG. 6B is a chart showing another signal waveform transmitted from the remote control transmitter in accordance with the second exemplary embodiment of the present invention.
Figure 7:
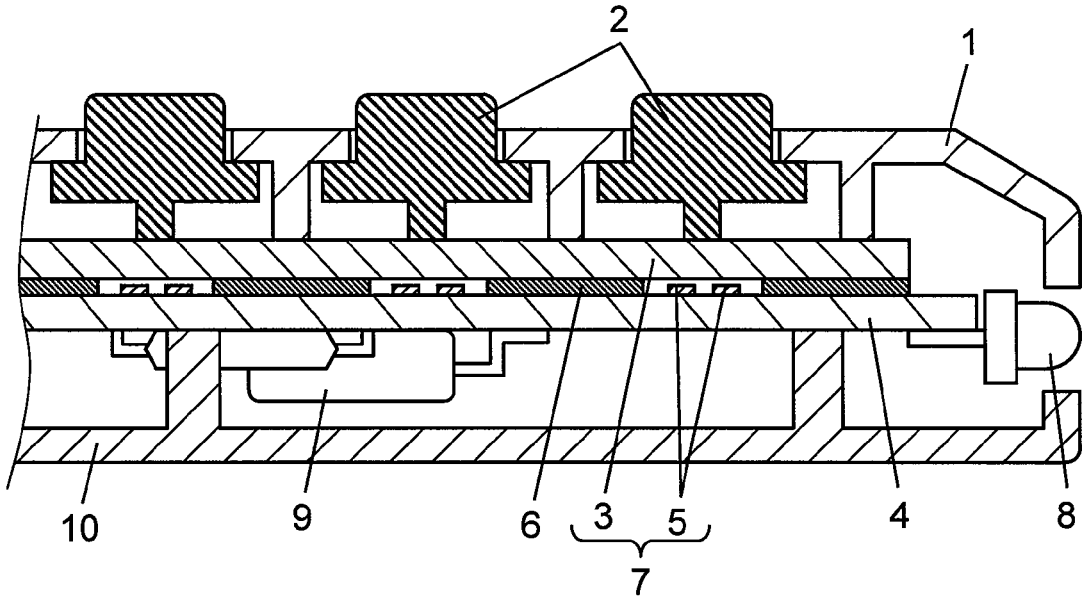
FIG. 7 PRIOR ART
FIG. 7 is a sectional view of a conventional remote control transmitter.
Figure 8:
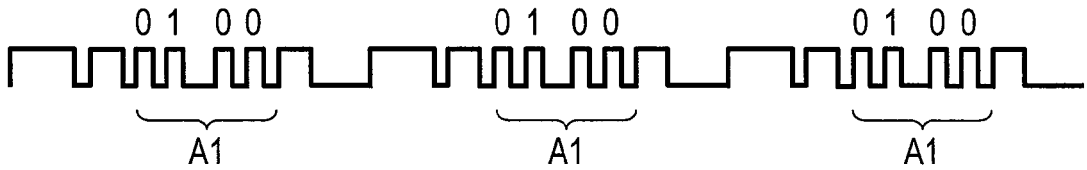
FIG. 8 PRIOR ART
FIG. 8 is a chart showing a signal waveform supplied from the conventional remote control transmitter.

FIG. 6A is a chart showing a signal waveform transmitted from a remote control transmitter in accordance with the second exemplary embodiment of the present invention. FIG. 6B is a chart showing another signal waveform transmitted from the remote control transmitter in accordance with the second exemplary embodiment of the present invention. The signal waveform shown in FIG. 6A is identical with the chart of the signal waveform (FIG. 4A) transmitted from the remote control transmitter in accordance with the first exemplary embodiment of the present invention.

The remote control transmitter of the second exemplary embodiment is different from the remote control transmitter of the first exemplary embodiment in that the transmitter of the second exemplary embodiment generates continuation signal C1 when operating body 2 is continuously held down with a constant force. With reference to FIG. 6B, when operating body 2 is continuously held down with a constant force, control part 19 detects that the resistance of corresponding contact part 18 is kept constant. For example, when the operating body is continuously held down with pressing force P1 that sets the resistance of contact part 18 at R1, transmission part 8 transmits operation signal A1 corresponding to resistance R1 and subsequently continuation signal C1. Thereafter, transmission is stopped.

Control part 19 detects the resistance of contact part 18 at predetermined intervals, e.g. 20 to 50 msec. When detecting that the resistance is kept at R1, the control part continues to stop transmission. When the resistance at pressing force P1 is kept at R1 even after a predetermined time period, e.g. one second, has elapsed, the control part causes transmission of operation signal A1 and continuation signal C1 again. While remote control receiver 32 receives this remote control signal, cursor 33 or pointer 34 displayed on display screen 31 is moved at a constant moving speed corresponding to resistance R1.

When the pressing force applied to operating body 2 is changed from P1 to P2, for example, the resistance of contact part 18 is changed to R2. Control part 19 detects this change, and causes transmission of operation signal A2 corresponding to resistance R2. When the resistance is kept at R2 thereafter, the control part sequentially causes transmission of continuation signal C1 and stops transmission. While remote control receiver 32 receives this remote control signal, cursor 33 or pointer 34 is moved at a constant moving speed corresponding to resistance R2.

When the finger is released from operating body 2 and the electrical connection in contact part 18 is broken, control part 19 detects this electrical disconnection and causes transmission of a stop signal (not shown) from transmission part 8. Thus, cursor 33 or pointer 34 is stopped on a menu item.

When operating body 2 is continuously held down with a constant force (e.g. pressing force P1), and the resistance of contact part 18 is kept constant at R1, control part 19 detects this constant state and causes transmission of continuation signal C1 having a predetermined number of pulses, instead of a remote control signal in which operation signals A1 and A2 having a larger number of pulses are repeated. Thereafter, the control part stops transmission. In other words, while operating body 2 is continuously held down with a constant force and the moving direction and speed of cursor 33 or pointer 34 displayed on display screen 31 are kept constant, the control part causes transmission of continuation signal C1 having a predetermined number of pulses and thereafter stops transmission. This operation makes the consumption of the internal battery much smaller than the case of the first exemplary embodiment.

Alternatively, when operating body 2 is continuously held down with a constant force (e.g. pressing force P1), the control part may cause transmission of continuation signal C1 after operation signal A1 repeated at a predetermined number of times, e.g. three times, instead of causing transmission of continuation signal C1 immediately after operation signal A1 as described above. Thereafter, control part 19 detects the resistance at predetermined intervals. Also when the pressing force is changed to P2, the control part may cause transmission of continuation signal C1 after operation signals A2 repeated at three times. Such an operation prevents erroneous transmission and reception caused by external noises and allows more secure remote control operation.

Further, when remote control receiver 32 receives neither continuation signal C1 nor a stop signal from the remote control transmitter even after a predetermined time period, e.g. one second, has elapsed after receiving operation signal A1 or A2 corresponding to constant resistance R1 or R2, respectively, the movement of cursor 33 or pointer 34 displayed on display screen 31 is stopped. Such an operation can prevent cursor 33 or pointer 34 from inadvertently making continuous movement when the remote control signal from the remote control transmitter is interrupted.

When control part 19 detects whether the resistance of contact part 18 is kept constant or not, the resistance of contact part 18 is changed in the range of several kilo-ohms to several mega-ohms. Thus, actually, the control part detects changes in the resistance within a predetermined range, in other words, whether the resistance is changed or not in a range covering 5 to 10% of several mega-ohms or the like.

As described above, in the second exemplary embodiment of the present invention, when the resistance of contact part 18 is kept constant, control part 19 for causing transmission of a remote control signal from transmission part 8 according to the resistance of contact part 18 causes transmission of continuation signal C1 and stops transmission. When operating body 2 is continuously held down with a constant force and the resistance of contact part 18 is kept constant, control part 19 causes transmission of continuation signal C1 having a predetermined number of pulses, and thereafter stops transmission. Such an operation can further reduce the consumption of the internal battery. Thus, a remote control transmitter capable of saving power and making various kinds of remote control operations on equipment can be provided.

In each of the above exemplary embodiments, a description is provide of the structure in which a plurality of operating bodies 2 are placed in a plurality of open holes through the top face of case 1 so that the operating bodies are vertically movable. However, the plurality of operating bodies may be integrally formed of an elastic material, such as rubber and elastomer, or a sheet-shaped operating body may be used. Then, a remote control transmitter may be structured so that pressing such an operating body allows operation of movable contact 17 and contact part 18 disposed below.

In each of the above exemplary embodiments, a description is provided of the structure in which control part 19 detects electrical connection in contact part 18 or changes in the resistance thereof, and cursor 33 or pointer 34 displayed on display screen 31 of electronic equipment 30 is moved according to changes in the pressing force applied to operating body 2. However, according to electrical connection in contact part 18 or changes in the resistance thereof, switching operations may be performed in an analog fashion as well as changing the sound volume of electronic equipment 30 and selecting reception channels. Such switching operations include changing the speed of scroll searching of menus, such as a list, displayed on display screen 31, and changing the speed of reproducing or fast-forwarding moving images.

Further, in each of the exemplary embodiments, a description is provided of the structure in which movable contact 17 is placed on contact part 18, and pressing operating body 2 resiliently inverts movable contact 17 to cause electrical connection in contact part 18 or change the resistance thereof. However, the present invention may have the following structures. Movable contact 17 is eliminated and operating body 2 directly presses contact part 18. Alternatively, a pressure-sensitive conductive sheet having conductive particles dispersed in a base material is used, and this pressure-sensitive conductive sheet is opposed to the fixed contacts to form pressure-sensitive conductive contact parts.

The remote control transmitter of the present invention is capable of saving power and making various kinds of remote control operations on equipment, and is useful mainly for operating various types of electronic equipment.

What is claimed is:

1. A remote control transmitter comprising:

an operating body attached to a top face of a case so as to be vertically movable;

a pressure-sensitive conductive contact part disposed on a bottom face of the operating body; and a control part for causing transmission of a remote control signal from a transmission part according to a resistance of the pressure-sensitive conductive contact part, wherein, when the resistance of the pressure-sensitive conductive contact part changes responsive to pressing the pressure-sensitive conductive contact part, the control part causes transmission of an operating signal having a first number of pulses within an interval, when the resistance of the pressure-sensitive conductive contact part is kept constant while continuing to press the pressure-sensitive conductive contact part, the control part causes periodic transmission of a repetition signal having a second number of pulses that are less than the first number of pulses within the interval.

2. The remote control transmitter according to claim 1, wherein the resistance of the pressure-sensitive conductive contact part corresponds to a pressing force applied to the operating body.

3. The remote control transmitter according to claim 2, wherein when the operating body is continuously held down with a constant pressing force, the control part detects that the resistance of corresponding pressure-sensitive conductive contact part is kept constant.

4. A remote control transmitter comprising:

an operating body attached to a top face of a case so as to be vertically movable;

a pressure-sensitive conductive contact part disposed on a bottom face of the operating body; and a control part for causing transmission of a remote control signal from a transmission part according to a resistance of the pressure-sensitive conductive contact part, wherein, when the resistance of the pressure-sensitive conductive contact part changes responsive to pressing the pressure-sensitive conductive contact part, the control part causes transmission of an operating signal having a first number of pulses within an interval, when the resistance of the pressure-sensitive conductive contact part is kept constant while continuing to press the pressure-sensitive conductive contact part, the control part causes transmission of a continuation signal having a predetermined second number of pulses within the interval and thereafter stops transmission.

5. The remote control transmitter according to claim 4, wherein the resistance of the pressure-sensitive conductive contact part corresponds to a pressing force applied to the operating body.

6. The remote control transmitter according to claim 5, wherein when the operating body is continuously held down with a constant pressing force, the control part detects that the resistance of corresponding pressure-sensitive conductive contact part is kept constant.

* * * * *